US009380892B2

(12) United States Patent
Kallinger

(10) Patent No.: US 9,380,892 B2
(45) Date of Patent: Jul. 5, 2016

(54) SYSTEM TO PRESERVE AND DISPLAY POSTAGE STAMPS

(71) Applicant: James R. Kallinger, Tallahassee, FL (US)

(72) Inventor: James R. Kallinger, Tallahassee, FL (US)

( * ) Notice: Subject to any disclaimer, the term of this patent is extended or adjusted under 35 U.S.C. 154(b) by 0 days.

(21) Appl. No.: 14/791,645

(22) Filed: Jul. 6, 2015

(65) Prior Publication Data

US 2016/0000240 A1 Jan. 7, 2016

Related U.S. Application Data

(60) Provisional application No. 61/998,700, filed on Jul. 7, 2014.

(51) Int. Cl.
*A47G 1/12* (2006.01)
*A47G 1/06* (2006.01)
*A63F 9/00* (2006.01)

(52) U.S. Cl.
CPC *A47G 1/12* (2013.01); *A47G 1/065* (2013.01); *A63F 9/00* (2013.01)

(58) Field of Classification Search
CPC ..... A47G 1/12; A47G 1/08; A47G 1/065; A47G 2001/0666; G09F 1/12
See application file for complete search history.

(56) References Cited

U.S. PATENT DOCUMENTS 2,303,929 A 12/1942 Gilbert
2,468,817 A 5/1949 Duchin
2,508,854 A 5/1950 Brodsky
2,571,188 A 10/1951 Benson
3,852,903 A 12/1974 Buco
3,917,274 A 11/1975 Carey
4,083,137 A 4/1978 Rozmanith
4,145,829 A * 3/1979 Peltier ..... B42F 5/04 40/771
5,012,601 A * 5/1991 Garland ..... G09F 1/12 40/718
5,040,671 A * 8/1991 Hager ..... A45C 11/18 206/39
5,371,963 A * 12/1994 Gallagher ..... A47G 1/06 40/768
5,546,685 A 8/1996 Gallagher
6,263,604 B1 * 7/2001 Williams ..... A47G 1/06 40/718
6,905,770 B2 * 6/2005 Kaliser ..... A47G 1/0605 40/700
2003/0146114 A1 * 8/2003 Hanshaw ..... A47G 1/12 206/0.84
2003/0196362 A1 * 10/2003 Harwell ..... G09F 1/12 40/661

OTHER PUBLICATIONS

Miller, Displaying Postage Stamp Collections and Keeping Them Safe, 2015, 2 pp, Church Hill Classics, available at http://www.diplomaframe.com/blog/tabid/178/entryid/234/displaying-stamp-collections-and-keeping-them-safe.aspx.

* cited by examiner

*Primary Examiner* — Gary Hoge
(74) *Attorney, Agent, or Firm* — Allen, Dyer, Doppelt, Milbrath & Gilchrist, P.A.

(57) ABSTRACT

A display case to preserve and display a postage stamp includes a bottom section, a mat board positioned on a top surface of the bottom section to mount a postage stamp, and a transparent archival film positioned on a top surface of the mat board to preserve and cover the postage stamp and compatible for archival contact with the postage stamp. The display case also includes a transparent protective sheet positioned on a top surface of the transparent archival film, and a top section having a window to display the postage stamp and coupled to the bottom section.

14 Claims, 4 Drawing Sheets

SYSTEM TO PRESERVE AND DISPLAY POSTAGE STAMPS

FIELD

The present invention relates to the field of philately, and, more particularly, to a system to preserve and display collectible postage stamps and related methods.

BACKGROUND

There are existing products and methods for attempting to preserve and protect collectible postage stamps. However, a shortcoming of the existing products and methods is that they offer limited protection from the eventually degradation of the ink and paper of the postage stamps over time and have virtually no preservative attributes. For example, one particular type of stamp mount is a sleeve for collectors to insert their display items and place the sleeve in an album as described in U.S. Pat. Nos. 2,508,854 and 3,852,903. Another similar type of product includes sliding a postage stamp under a transparent cover as described in U.S. Pat. No. 4,083,137. Yet another type includes books that have multiple pages with pouches into which collectors arrange their collectible postage stamps.

Collectors even place postage stamps into picture frames as described in U.S. Pat. No. 5,546,685, which also provides little to no protection to the postage stamps from various forms of degradation. Another known method to store stamps includes adhering stamp hinges to the backs of postage stamps and pasting them into an album. However, these products and methods fail to properly preserve the postage stamps over time. Accordingly, there is a need in the art for a system that properly preserves postage stamps from degradation while at the same time making it easy to display and enjoy the collectible postage stamps.

SUMMARY

In view of the foregoing background, it is therefore an object of the present invention to provide a system to preserve and display postage stamps. This and other objects, features, and advantages in accordance with the present invention are provided in a particular embodiment by a case. The case includes a bottom section, a mat board positioned on a top surface of the bottom section to mount a postage stamp, and a transparent archival film positioned on a top surface of the mat board to preserve and cover the postage stamp and which is compatible for archival contact with the postage stamp. In addition, the case includes a transparent protective sheet positioned on a top surface of the archival film, and a top section coupled to the bottom section and having a window therein to display the postage stamp.

In another particular illustrative embodiment, a system to preserve and display postage stamps is disclosed. The system includes a frame having a plurality of lateral dividers and longitudinal dividers forming a plurality of cells aligned in rows and columns to accommodate a plurality of cases. Each case includes a bottom section, a mat board positioned on a top surface of the bottom section to mount a postage stamp, and a transparent archival film positioned on a top surface of the mat board to preserve and cover the postage stamp and compatible for archival contact with the postage stamp. Each case also includes a transparent protective sheet positioned on a top surface of the transparent archival film, and a top section having a window to display the postage stamp and coupled to the bottom section.

In another particular embodiment, a method to preserve and display postage stamps is disclosed. The method includes positioning a mat board on a bottom section and positioning a postage stamp on an upper surface of the mat board. The method also includes positioning a transparent archival film on a top surface of the mat board to preserve and cover the postage stamp, positioning a transparent protective sheet on a top surface of the archival film, and coupling a top section to the bottom section to display the postage stamp therein.

DETAILED DESCRIPTION

Figure 1:
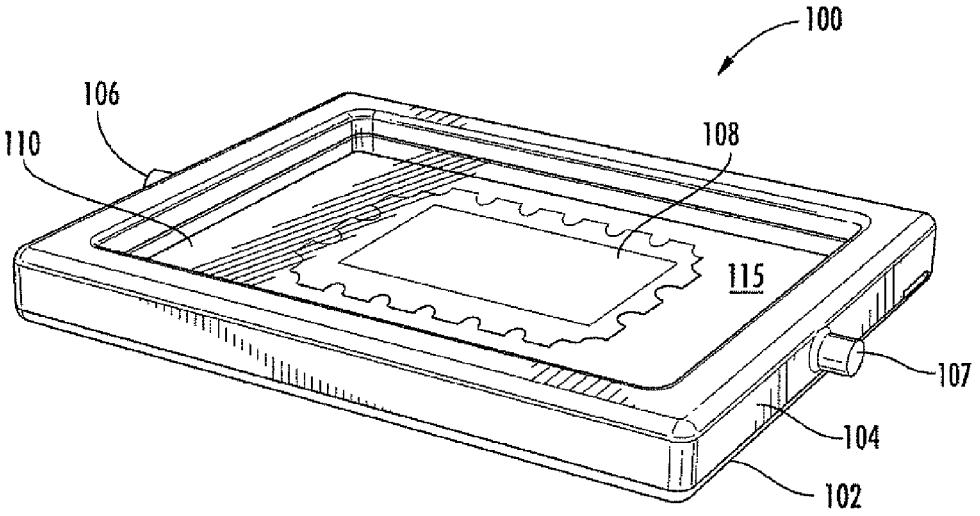
FIG. 1 is a top perspective view of a case to preserve and display postage stamps.
Figure 2:
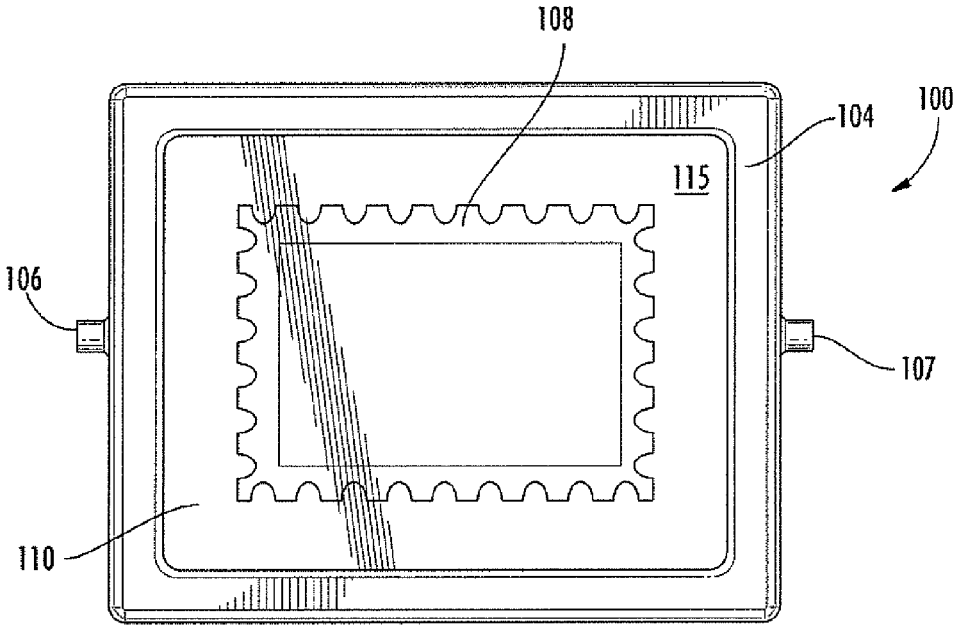
FIG. 2 is a top view of the case.
Figure 3:
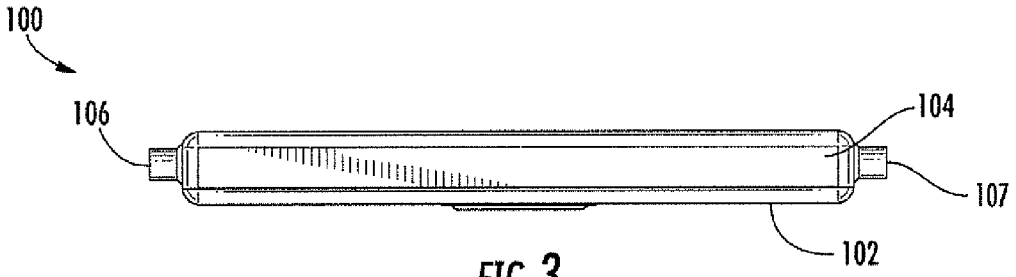
FIG. 3 is a front elevational view of the case.
Figure 4:
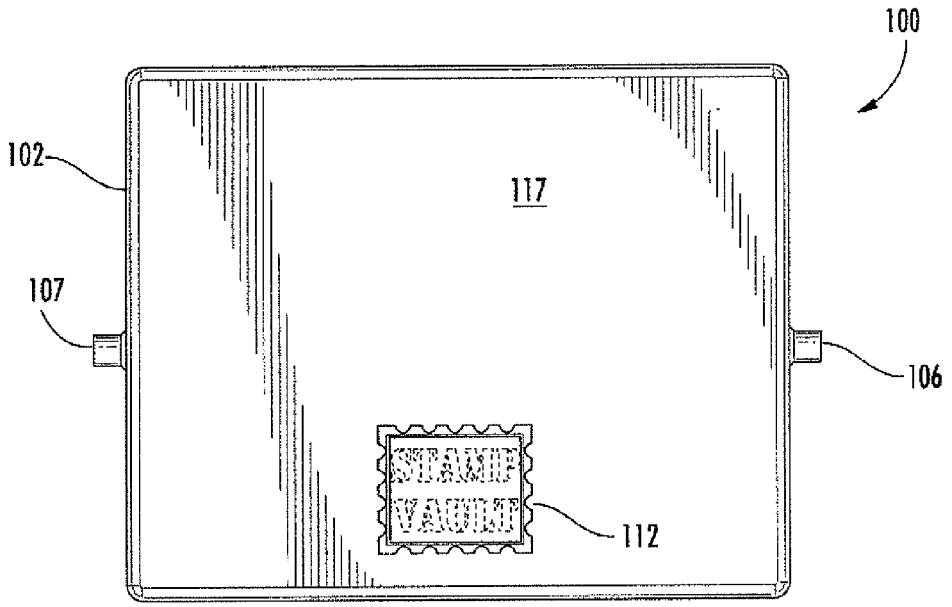
FIG. 4 is a bottom view of the case.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 1-4, a case 100 is shown that is generally rectangular in shape. However, any shape of the case 100 may be used. A bottom section 102 is secured to a top section 104. The bottom section 102 and the top section 104 can be separated in order to gain access to an interior of the case 100. A pair of protrusions 106, 107 is located on respective lateral sides of the top section 104. A stamp 108 is enclosed within the case 100 and is viewable through a window 115 in the top section 104. A protective sheet 110 is positioned over the stamp 108 and serves as an outer layer of the case 100. The protective sheet 110 is transparent so that the stamp 108 is visible. The case 100 has a thickness that is less than a width or length of the case 100. A bottom surface of a base 117 of the bottom section 102 may include an indicator 112, a trademark for example, that is located proximate to an edge of the bottom section 102. The indicator 112 can be used to orientate the position of the postage stamp 108 correctly in the bottom section 102 so that the postage stamp 108 is not orientated incorrectly (e.g., upside down) when the case 100 is assembled.

Figure 5:
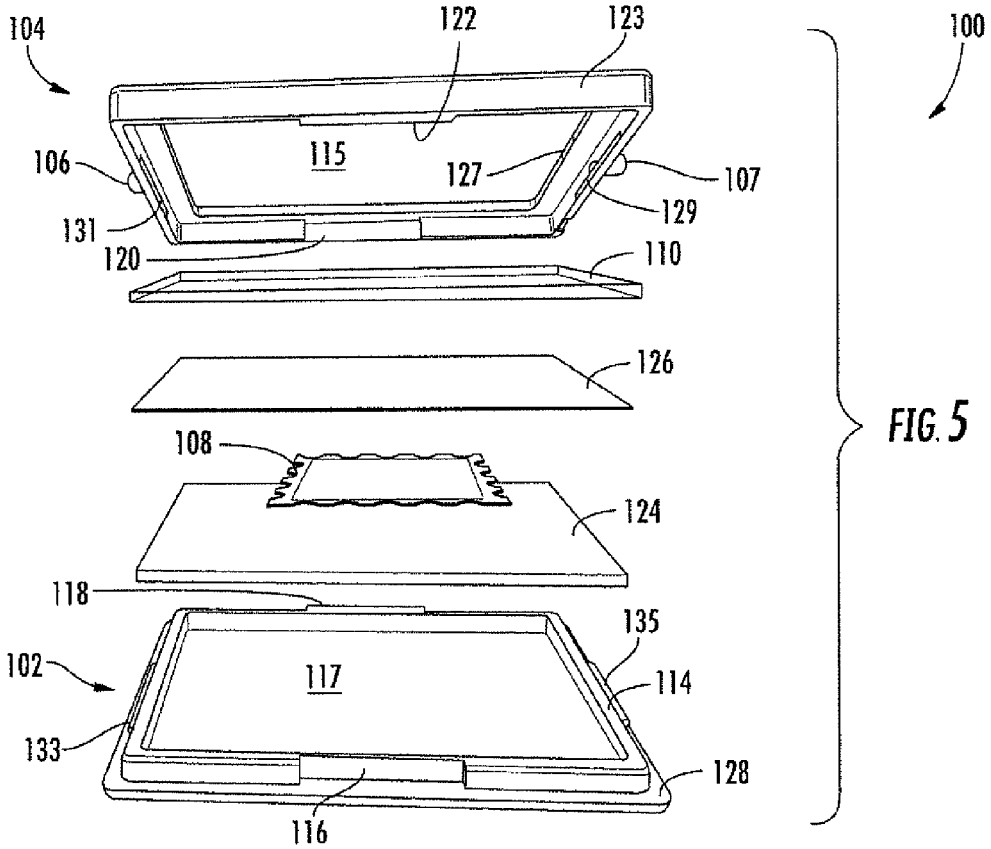
FIG. 5 is a front exploded perspective view of the case.

Referring now to FIG. 5, an exploded view of the case 100 is shown. The bottom section 102 has a mat board 124 positioned on a top surface to mount the stamp 108. The bottom section 102 includes a ridge ring 114 extending upwardly from the base 117 of the bottom section 102. The ridge ring 114 includes a first tab 118 extending laterally outwardly from a side of the ridge ring 114. The ridge ring 114 also includes a first recess 116 thereon on a side thereof opposite of the first tab 118. In addition, the bottom section 102 may include a ledge 128 around the ridge ring 114.

The top section 104 includes a rectangular (Or any other shape) frame 127 defining a window 115, and a sidewall ring 123 extending downwardly therefrom. The sidewall ring 123 of the top section 104 has a second recess 120 in a side thereof and configured to matingly engage the first tab 118 of the bottom section 102. The top section 104 also includes a second tab 122 extending laterally inwardly from a side of the sidewall ring 123 on a side thereof opposite the second recess 120 and configured to matingly engage the first recess 116 when coupling the top section 104 to the bottom section 102. The first and second tabs 118, 122 and first and second recesses 116, 120 are configured so that the bottom section 102 and the top section 104 can be coupled together in the intended orientation for displaying the postage stamp 108. A lower locking ridge 133, 135 around an interior of the ridge ring 114 is configured to slip over an upper locking ridge 129, 131 around an interior of the sidewall ring to hold the top section 104 and bottom section 102 together.

A mat board 124 is positioned on a top surface of the base 117 of the bottom section 102 to hold and mount the postage stamp 108. The mat board 124 includes acid-free and lignin free materials buffered to maintain alkaline pH in order to help protect and preserve the postage stamp 108. A transparent archival film 126 is positioned on a top surface of the mat board 124 to preserve and cover the postage stamp 108. The transparent archival film 126 is compatible for archival contact with the postage stamp 108 and does not change with time to become yellowed or brittle or damage the postage stamp 108. The transparent archival film 126 is preferably polyester or polypropylene and not polyvinyl chloride (PVC).

The transparent protective sheet 110 discussed above is positioned on the top surface of the transparent archival film 126 so that the transparent archival film 126 is sandwiched between the protective sheet 110 and the postage stamp 108. In addition, the case 100 may be airtight when the bottom section 102 is coupled to the top section 104 to protect the postage stamp 108 from the ambient air. The transparent archival film 126 and the transparent protective sheet 110 may also be treated to block ultraviolet radiation that could damage the postage stamp 108.

Figure 6:
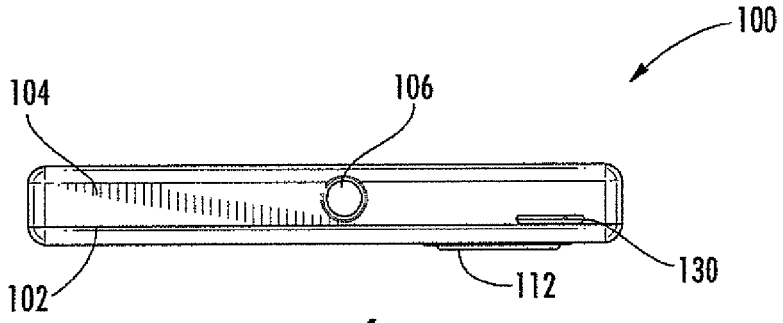
FIG. 6 is a left side elevational view of the case.
Figure 7:
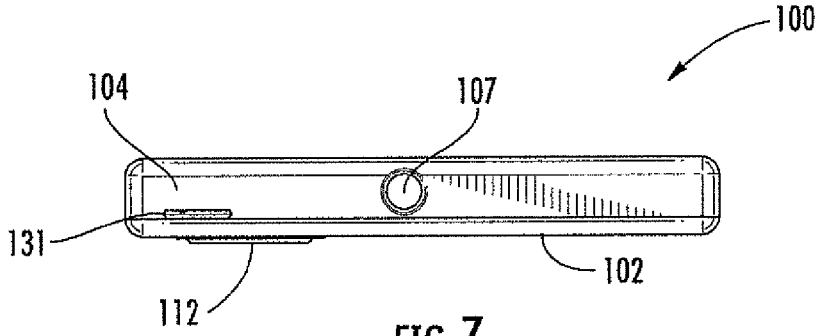
FIG. 7 is a right side elevational view of the case.

Referring now to FIGS. 6 and 7, a left notch 130 and a right notch 131 may be located at the sidewall ring 123 of the top section 104 at the interface with the bottom section 102. An object, a fingernail for example, can be inserted into the left and/or right notches 130, 131 in order to help pry the bottom section 102 apart from the top section 104 to gain access to the interior of the case 100. The protrusions 106, 107 of the top section 104 described above may not be centered on the lateral sides of the top section 104. Instead, the locations of the protrusions 106, 107 may be closer to a bottom edge of the top section 104 than a top edge.

Figure 8:
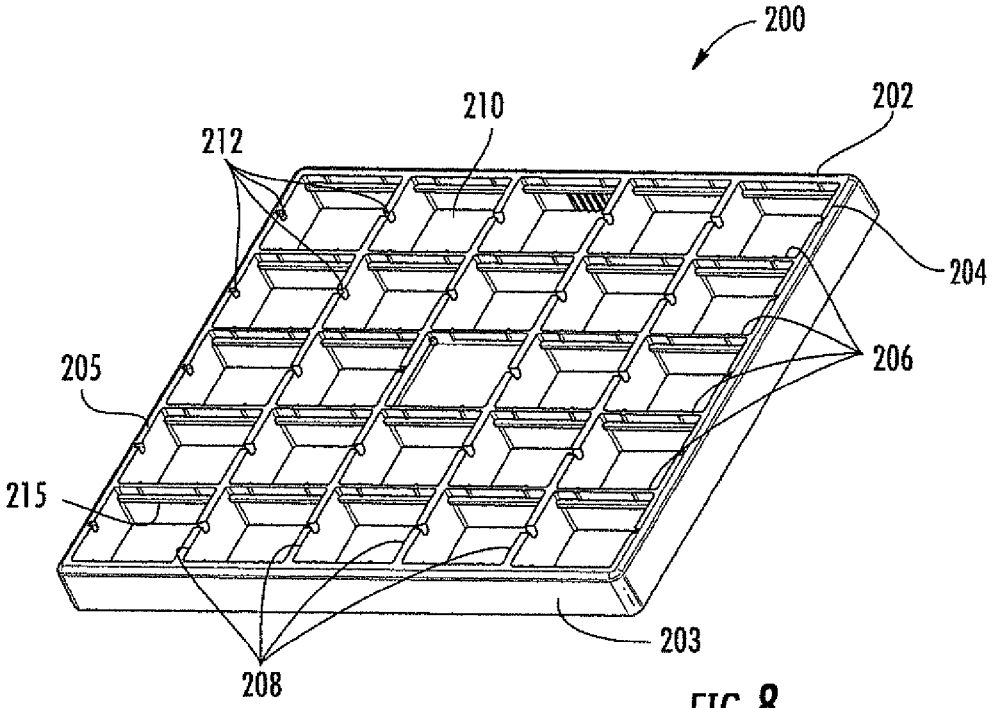
FIG. 8 is a top perspective view of a frame to display the case shown in FIGS. 1-7.
Figure 9:
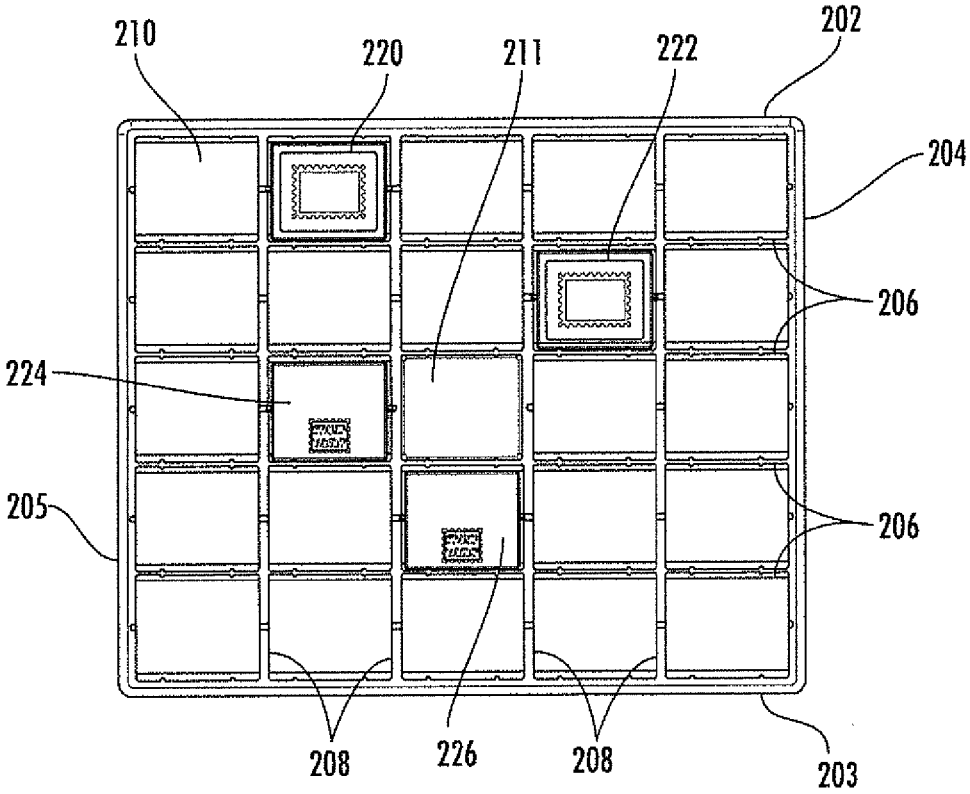
FIG. 9 is a top view of the frame showing cases placed within the frame.

The location of the protrusions 106, 107 are such that when the case 100 is placed in frame 200 as shown in FIGS. 8 and 9, that the case 100 can rotate in only one direction when being flipped face up to face down, and vice versa. The perimeter of the frame 200 is defined by a pair of opposing lateral frame members 202, 203 and a pair of opposing longitudinal frame members 204, 205. The frame 200 also includes lateral dividers 206 and longitudinal dividers 208 that form cells 210 aligned in rows and columns. More or less lateral and longitudinal dividers 206, 208 may be used to create the desired number of cells 210. The longitudinal dividers 208 include notches 212 that receive the protrusions 106, 107 of the case 100 in order to suspend the case 100 from the pair of protrusions 106, 107 within the cell 210. Each cell 210 also includes a stop 215 that is configured to support the case 100 in the face up or face down position and limits the case 100 from over rotating in either direction.

In use, a number of cases 220, 222, 224, 226 are placed in the frame 200. For example, cases 220, 222 are flipped face up to display a particular postage stamp contained inside the respective case. Cases 224, 226 are flipped face down so that the postage stamp 108 is not visible. When the frame 200 is in a display mode, all the cases 220, 222, 224, 226 are flipped face up in order to display the collection of postage stamps within the respective cases 220, 222, 224, 226. In this particular embodiment, the frame 200 includes twenty-five cells 210 but not all the cells 210 are filled, and the center cell 211 may be filled with a logo instead of a case. The cases 220, 222, 224, 226 can be easily flipped face up or easily removed from the frame 200 to closely view and inspect the respective postage stamps contained inside.

In another embodiment, a method to preserve and display postage may include positioning a mat board on a bottom section and positioning a postage stamp on an upper surface of the mat board. In addition, the method includes positioning a transparent archival film on a top surface of the mat board to preserve and cover the postage stamp, positioning a transparent protective sheet on a top surface of the transparent archival film, and coupling a top section to the bottom section to display the postage stamp therein. The method may also include engaging a tab and a recess of the bottom section to a corresponding recess and tab, respectively, of the top section.

A memory game can also be played with the frame 200 described above in a game mode. For example, several cases 100 are initially placed face down in the cells 210 of the frame 200. At least two cases contain the same issued postage stamp, for example cases 220, 222. The remaining cases 224, 226 do not contain the same issued postage stamp but instead contain a different postage stamp or do not contain a postage stamp at all.

A first player selects a first case (e.g., case 220) from all the cases 220, 222, 224, 226 that are initially placed face down in the frame 200. The first player flips the first case 220 face up to view the postage stamp contained therein. The first player then attempts to find another case having a matching postage stamp to the first case 220.

Accordingly, the first player selects a second case (e.g., 222) and flips the second case 222 face up to see the postage stamp as shown in FIG. 9. If the postage stamp of the second case 222 matches the postage stamp of the first case 220, then the first player leaves the cases 220, 222 flipped face up so that the postage stamps are both displayed and the first player is awarded a point. If the postage stamps do not match, then the first player flips both cases 220, 222 face down and a second player takes a turn and repeats the process to identify matching postage stamps. The players are required to memorize the locations of the cases containing the particular postage stamps in order to make the most matches. The player that makes the most matches and accumulates the most points wins the game.

Figure 10:
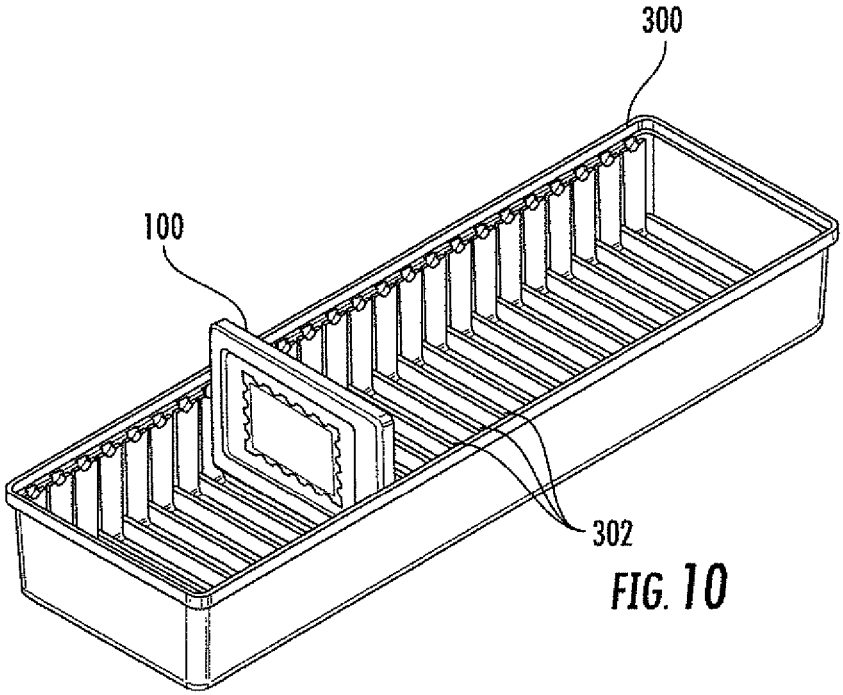
FIG. 10 is a perspective view of a tray to store the cases.

Referring now to FIG. 10, a rectangular shaped tray 300 can also be used to organize and store the cases 100. The tray 300 includes several slots 302 that may be equidistantly spaced so that several cases 100 can be aligned one after another front to back.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A display case to preserve and display a postage stamp, the display case comprising:

a bottom section comprising a base, a ridge ring extending upwardly from the base and inwardly spaced from a periphery of the base, and a first tab extending laterally outwardly from a side of said ridge ring, and said ridge ring having a first recess therein on a side thereof opposite said first tab;

a mat board positioned on a top surface of the bottom section to mount a postage stamp;

a transparent archival film positioned on a top surface of the mat board to preserve and cover the postage stamp and compatible for archival contact with the postage stamp;

a transparent protective sheet positioned on a top surface of the transparent archival film; and a top section having a window to display the postage stamp and coupled to the bottom section.

2. The display case of claim 1, wherein the top section comprises a rectangular frame defining the window, and a sidewall ring extending downwardly therefrom.

3. The display case of claim 2, wherein the sidewall ring has a second recess in a side thereof and configured to matingly engage the first tab of the bottom section; and further comprising a second tab extending laterally inwardly from a side of the sidewall ring on a side thereof opposite the second recess and configured to matingly engage the first recess when coupling the top section to the bottom section.

4. The display case of claim 3, wherein the top section comprises a pair of protrusions extending outwardly from the sidewall ring and configured to rotatably mount the case.

5. The display case of 1, wherein the archival film comprises polyester; and wherein the mat board comprises acid-free materials.

6. A system to preserve and display postage stamps, the system comprising:

a frame having a plurality of lateral dividers and longitudinal dividers forming a plurality of cells aligned in rows and columns; and a plurality of cases, each case to fit in a respective cell, and each case comprising, a bottom section, a mat board positioned on a top surface of the bottom section to mount a postage stamp, a transparent archival film positioned on a top surface of the mat board to preserve and cover the postage stamp and compatible for archival contact with the postage stamp, a transparent protective sheet positioned on a top surface of the transparent archival film, and a top section having a window to display the postage stamp and coupled to the bottom section, and the top section comprising a frame defining the window, a sidewall ring extending downwardly therefrom, and a pair of protrusions extending outwardly from the sidewall ring and configured to rotatably mount the case; and the plurality of longitudinal dividers each having at least one notch configured to receive a protrusion to suspend a respective case from the pair of protrusions within a respective cell.

7. The system of claim 6, wherein the bottom section further comprises a rectangular base and a ridge ring extending upwardly therefrom.

8. The system of claim 6, wherein the bottom section comprises a first tab extending laterally outwardly from a side of said ridge ring; and wherein said ridge ring has a first recess therein on a side thereof opposite said first tab.

9. The system of claim 8, wherein the sidewall ring has a second recess in a side thereof and configured to matingly engage the first tab of the bottom section; and further comprising a second tab extending laterally inwardly from a side of the sidewall ring on a side thereof opposite the second recess and configured to matingly engage the first recess when coupling the top section to the bottom section.

10. The system of claim 6, wherein the archival film comprises polyester.

11. The system of claim 6, wherein the mat board comprises acid-free materials.

12. The system of claim 6, wherein each case is airtight when the top section is coupled to the bottom section.

13. A method to preserve and display postage stamps, the method comprising:

positioning a mat board on a bottom section, the bottom section comprising a base, a ridge ring extending upwardly from the base and inwardly spaced from a periphery of the base, and a tab extending laterally outwardly from a side of said ridge ring, and said ridge ring having a recess therein on a side thereof opposite said tab;

positioning a postage stamp on an upper surface of the mat board;

positioning an archival film on a top surface of the mat board to preserve and cover the postage stamp;

positioning a protective sheet on a top surface of the archival film; and coupling a top section to the bottom section to display the postage stamp therein.

14. The method of claim 13, further comprising engaging the tab and the recess of the bottom section to a corresponding recess and tab, respectively, of the top section.

* * * * *